US009822558B1

(12) United States Patent
Blankenship

(10) Patent No.: US 9,822,558 B1
(45) Date of Patent: Nov. 21, 2017

(54) TAMPER EVIDENT TRAILER LOCK

(71) Applicant: 3CA Enterprises, Inc., Bartlett, IL (US)

(72) Inventor: Daniel Blankenship, Bartlett, IL (US)

(73) Assignee: 3CA Enterprises, Inc., Bartlett, IL (US)

( * ) Notice: Subject to any disclaimer, the term of this patent is extended or adjusted under 35 U.S.C. 154(b) by 0 days.

(21) Appl. No.: 15/432,622

(22) Filed: Feb. 14, 2017

(51) Int. Cl.
*E05B 67/38* (2006.01)
*E05B 17/00* (2006.01)
*E05B 83/02* (2014.01)

(52) U.S. Cl.
CPC ..... *E05B 67/38* (2013.01); *E05B 17/0062* (2013.01); *E05B 83/02* (2013.01)

(58) Field of Classification Search
CPC ..... E05B 17/0062; E05B 83/02; E05B 67/38; E05B 17/2084; E05B 67/383; E05B 83/12; Y10T 70/577; Y10T 70/498; Y10T 70/5774; Y10T 70/5739; Y10T 70/5779; Y10T 292/1086; Y10T 70/573; Y10T 70/5735; Y10T 292/089; Y10T 292/0994; Y10T 292/48; Y10T 70/493; Y10T 70/5093; Y10T 70/5087; Y10T 70/05
USPC ..... 70/2, 54–56, 201–203, 211, 212, 232; 292/DIG. 32, 148, 205, 208, 218, 292/281–286, 307 R
See application file for complete search history.

(56) References Cited

U.S. PATENT DOCUMENTS 1,626,273 A * 4/1927 Dietze ..... G06F 3/0305 292/321
1,964,897 A * 7/1934 Wenk ..... G09F 3/0358 292/320
3,367,701 A * 2/1968 Wenk, Jr. ..... G09F 3/0358 292/321
3,563,069 A * 2/1971 Ferrer ..... E05B 13/001 292/150
3,934,434 A * 1/1976 Law ..... E05B 19/0005 70/63
4,033,156 A * 7/1977 Cottingham ..... E05B 17/002 174/67
4,676,084 A * 6/1987 Signorelli ..... E05B 39/02 292/307 R
4,898,008 A 2/1990 Eberly
5,145,222 A 9/1992 Meyer
(Continued)

FOREIGN PATENT DOCUMENTS

EP 0 585 990 B1 10/1996

*Primary Examiner* — Suzanne Barrett
(74) *Attorney, Agent, or Firm* — Leydig, Voit & Mayer, Ltd.

(57) ABSTRACT

A cover for a handle of a cargo door to cover hasp elements and a lock. The cover includes a first housing with a first front wall, first side walls each having a front and rear edge, and a top end wall and define a first housing interior. A guide leg and a latch is disposed on the first housing. A second housing includes a second front wall, second side walls, and a bottom end wall that define a second housing interior. The second housing includes a guide socket configured to receive the guide leg and a catch configured to receive and retain the latch. The housing interiors define a cover interior that covers the hasp elements and an installed lock with one of the guide leg and the latch disposed behind the handle and the other of the guide leg and the latch disposed in front of the handle.

22 Claims, 12 Drawing Sheets

(56) References Cited

U.S. PATENT DOCUMENTS

| | | | | | |
|---|---|---|---|---|---|
| 5,261,258 | A * | 11/1993 | Bunger | E05B 67/38 | 292/148 |
| 5,375,916 | A * | 12/1994 | Cook | B60R 25/08 | 303/89 |
| 5,566,828 | A * | 10/1996 | Claes | A61M 5/003 | 206/1.5 |
| 5,697,235 | A * | 12/1997 | Briones | B60R 25/0221 | 70/18 |
| 5,934,116 | A | 8/1999 | Moore | | |
| 6,010,166 | A * | 1/2000 | Hamilton | E05B 13/002 | 292/282 |
| 6,581,419 | B1 | 6/2003 | Strodtman | | |
| 6,928,843 | B1 * | 8/2005 | Pirnie | E05B 67/38 | 292/205 |
| 7,257,972 | B2 * | 8/2007 | Bright | A47K 1/09 | 132/308 |
| 7,278,284 | B1 * | 10/2007 | James | E05B 13/002 | 292/205 |
| 2007/0024064 | A1 * | 2/2007 | Carter | G09F 3/0317 | 292/281 |
| 2012/0293655 | A1 * | 11/2012 | Loughlin | H04N 7/183 | 348/143 |

* cited by examiner

TAMPER EVIDENT TRAILER LOCK

TECHNICAL FIELD

The present disclosure relates to covers, particularly an assembly that covers lockrod type rear-end locking closures for vans.

BACKGROUND

Truck trailers, and trucks with similar closed cargo areas, such as shown in FIG. 1, include a closing apparatus and closure for holding the doors of the closed cargo area closed. The closure generally has provision for placing a lock such as a padlock or pin lock thereon to lock the doors and discourage unauthorized entry into the cargo area. As shown in FIG. 1, the rear of a truck trailer 10 includes two cargo doors 11 and 12 hinged to the trailer 10 by hinges 13. A vertical shaft 14 is rotatably mounted on door 12 by brackets 15. Closing elements 16 are secured to opposite ends of shaft 14 and cooperate with closing brackets 17 secured to trailer 10. A handle 18 is pivotally mounted to shaft 14 by bracket 19. In operation, shaft 14 is rotated by pulling handle 18 outwardly toward the viewer in FIG. 1. This rotates closing elements 16 inwardly toward the trailer releasing the closing elements 16 from closing brackets 17 allowing door 12 to be swung open. Door edge 20 extends from door 12 to overlap the edge of door 11. With door 12 swung open enough to move edge 20 outwardly from door 11, door 11 can also be swung open. To close the doors, door 11 is swung closed and then door 12 is swung closed. When closing door 12, handle 18 is rotated outwardly and as the door closes against the trailer, handle 18 is rotated inwardly toward the trailer to rotate closing elements 16 outwardly so the ends of closing elements 16 move behind the ends of closing brackets 17 to secure the doors in closed position. Door 11 is secured in closed position by overlapping edge 20 of door 12.

In order to hold handle 18 in rotated closed position adjacent the doors as shown in FIG. 1, a closure 25 for handle 18 is provided secured to door 11. Closure 25 includes lower latching element 26 secured to door 11 and rotatable upper latching element 27 rotatably secured to door 11. As well known, latch element 27 can be rotated upwardly out of the way to allow handle 18 to be positioned in latch element 26 and then latch element 27 is rotated to the position shown to enclose handle 18. As shown in FIG. 2, upper latch element 27 would be rotated from the position shown to allow handle 18 to be moved up and out of lower latch element 26, or similarly up and into lower latch element 26. With handle 18 in lower latch element 26, upper latch element 27 is rotated clockwise to the closed position shown in FIG. 2. A stop 28 stops rotation in the closed position shown. Tabs 30 and 31 extending from latching elements 26 and 27, respectively, include openings 32 and 33, respectively, therethrough to receive the lock member of a lock. Various locks can be used such as a pad lock 35 as shown in FIG. 1. Variations of the above configuration are contemplated.

A known problem with the closure as described and as currently known and used is that brackets 26 and 27 are open to tampering and can be relatively easily broken or destroyed with common tools such as a crowbar or metal cutter. Regardless of the lock used, the weak points in the latch are the latching elements 26 and 27. Breaking and entering of trailers and cargo trucks is a serious problem and a large number of such trailers and cargo trucks have a closure as described.

SUMMARY OF THE DISCLOSURE

One aspect of the disclosure is a cover for installation on a handle of a cargo door of a cargo carrying vehicle and shipping containers to substantially cover existing top and bottom hasp elements and a lock device installed through the hasp elements. The cover includes a first housing. The first housing includes a first front wall, laterally opposed first side walls attached to the first front wall, the first side walls each having a front edge and a rear edge, the first side walls attached to the first front wall at or near the front edge, and a top end wall attached to the first front and side walls. The first front wall, first side walls and top end wall define a first housing interior. A guide leg is disposed on the first housing. A latch is disposed on the first housing. A second housing includes a second front wall, laterally opposed second side walls attached to the second front wall, the second side walls attached to the second front wall, and a bottom end wall attached to the second front and side walls. The second front wall, second side walls and bottom end wall define a second housing interior. A guide socket is disposed on the second housing, the guide socket configured to slidably receive the guide leg. A catch is disposed on the second housing, the catch configured to receive and retain the latch. The first and second housing interiors together define a cover interior that is sized and shaped to substantially cover the top and bottom hasp elements and a lock device installed through the hasp elements with one of the guide leg and the latch disposed behind the handle and the other of the guide leg and the latch disposed in front of the handle when the cover is assembled thereon.

Further and alternative aspects and features of the disclosed principles will be appreciated from the following detailed description and the accompanying drawings. As will be appreciated, the principles related to covers for closures disclosed herein are capable of being carried out in other and different embodiments, and capable of being modified in various respects. Accordingly, it is to be understood that both the foregoing general description and the following detailed description are exemplary and explanatory only and do not restrict the scope of the appended claims.

BRIEF DESCRIPTION OF THE DRAWINGS

FIG. 2 is a close up view of a locking system including a handle and closure elements configured to secure the handle with the shackle of a lock or the like.

DETAILED DESCRIPTION

Figure 1:
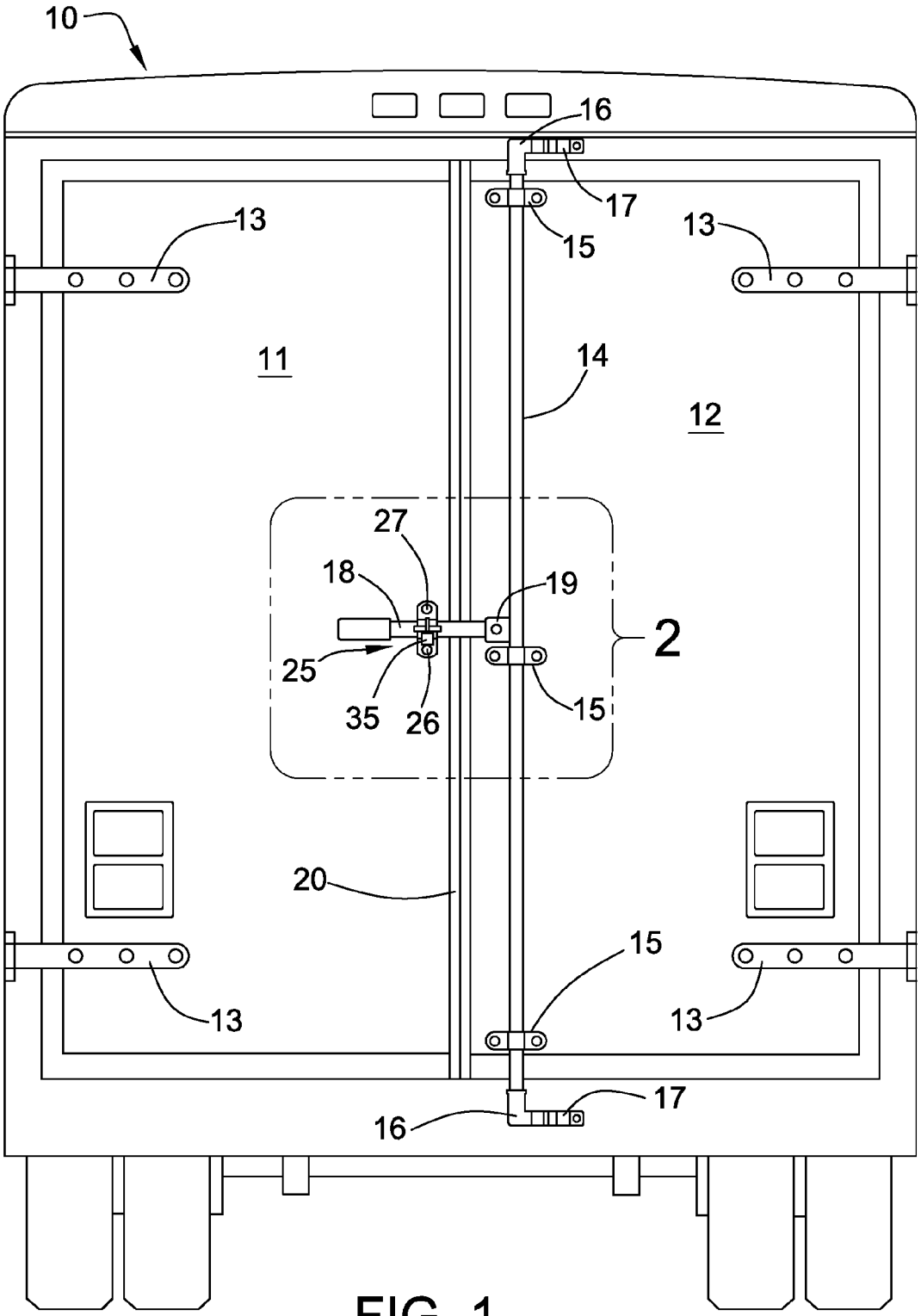
FIG. 1 (PRIOR ART)
FIG. 1 is a rear elevation of a truck trailer showing the doors and a locking closure system for a cargo trailer or cargo truck.
Figure 2:
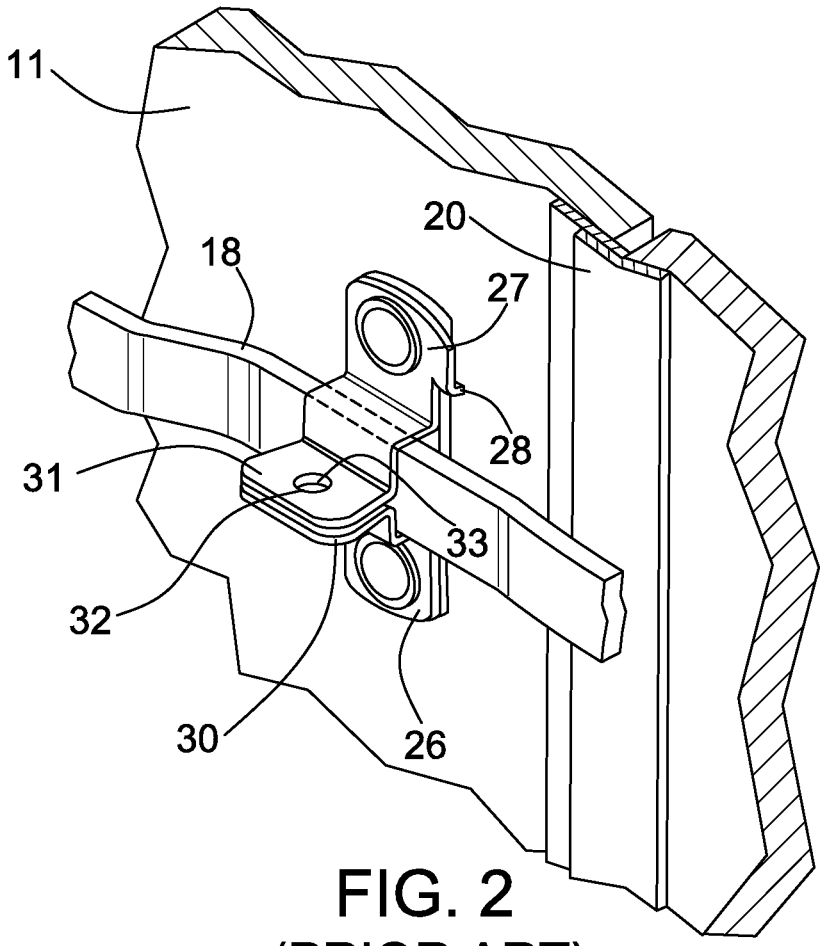
FIG. 2 (PRIOR ART)
Figure 3:
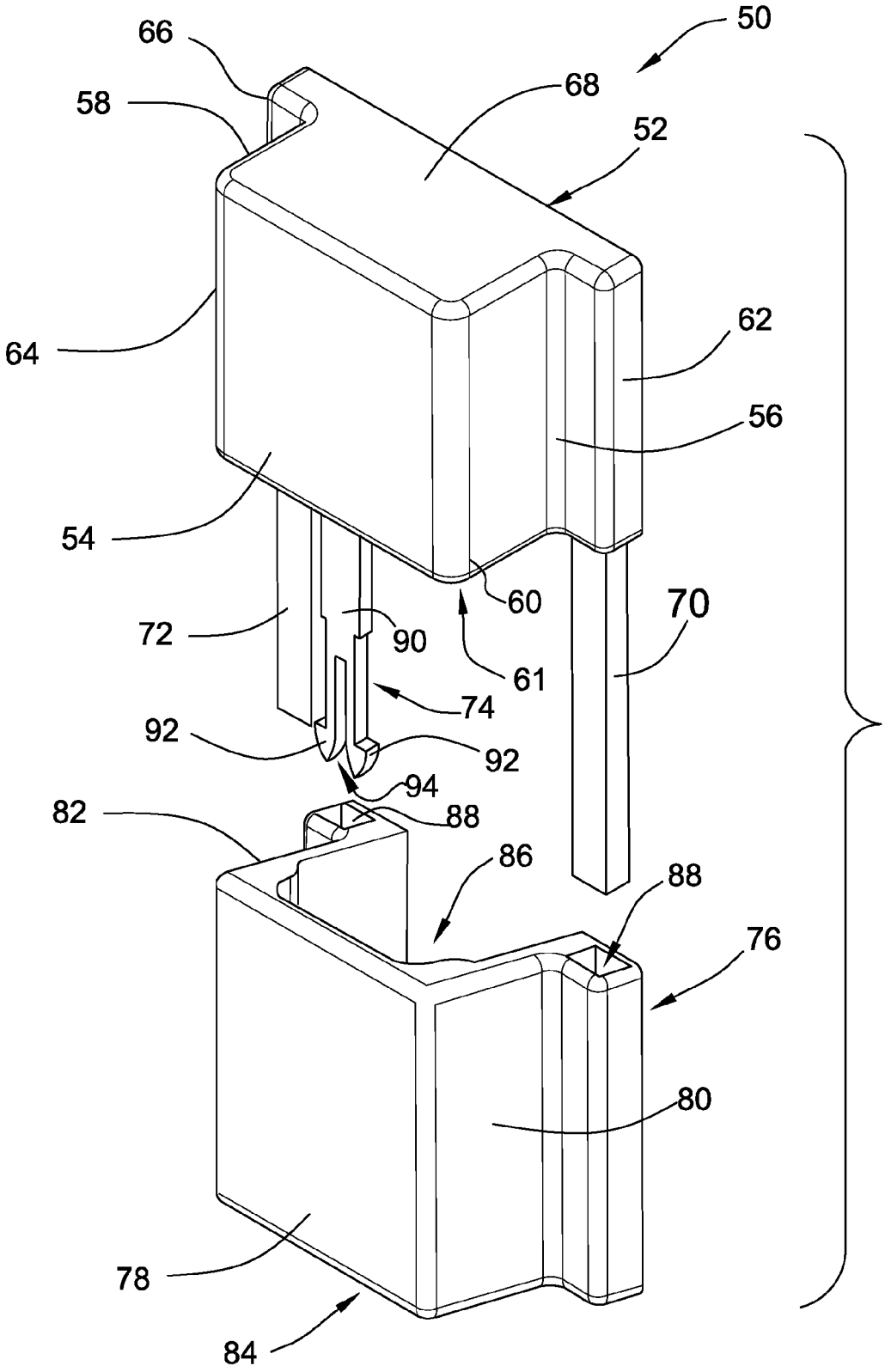
FIG. 3 is an exploded perspective view of a lock cover according to an embodiment of the disclosure.
Figure 4:
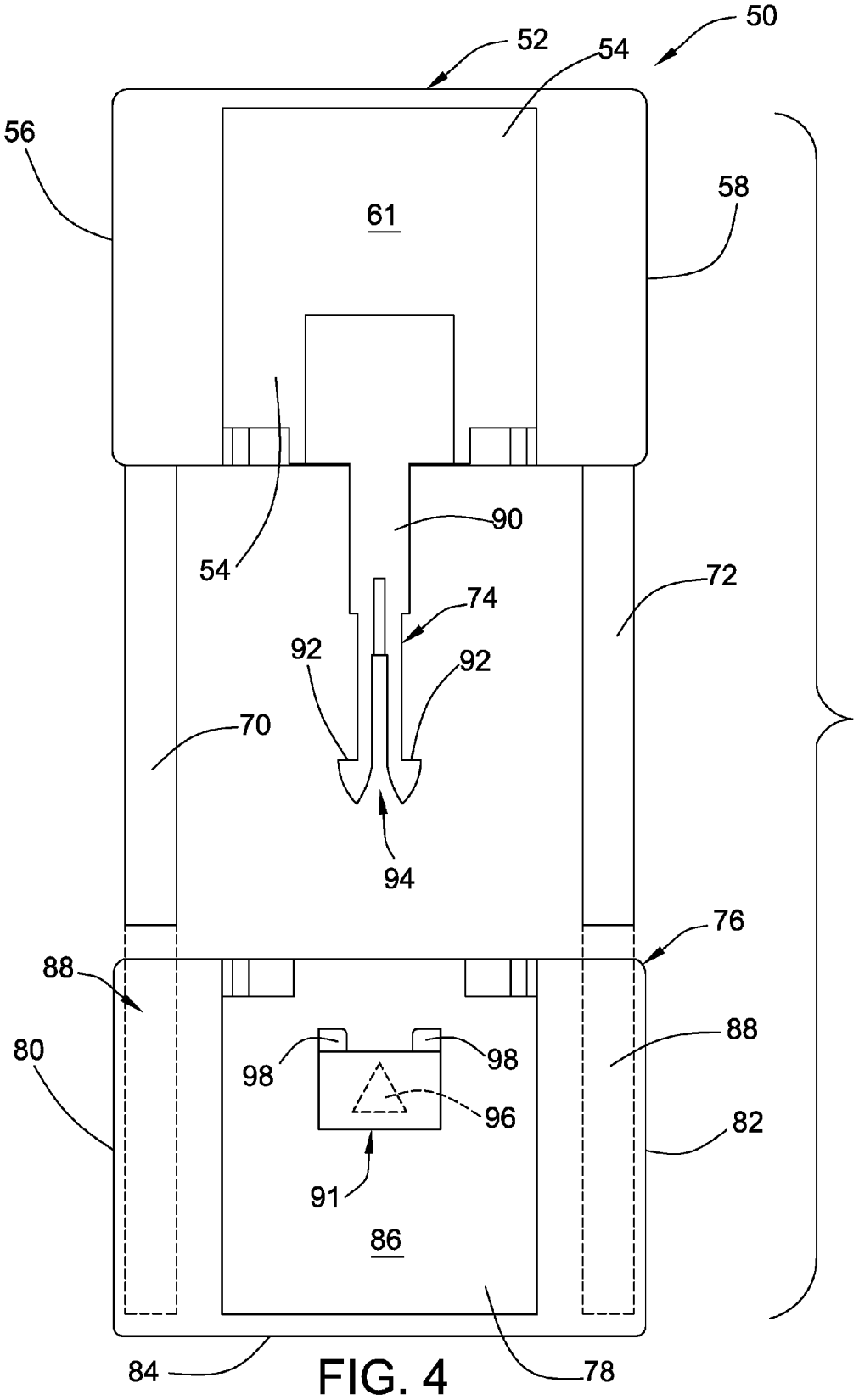
FIG. 4 is an exploded rear view of the lock cover of FIG. 3.
Figure 5:
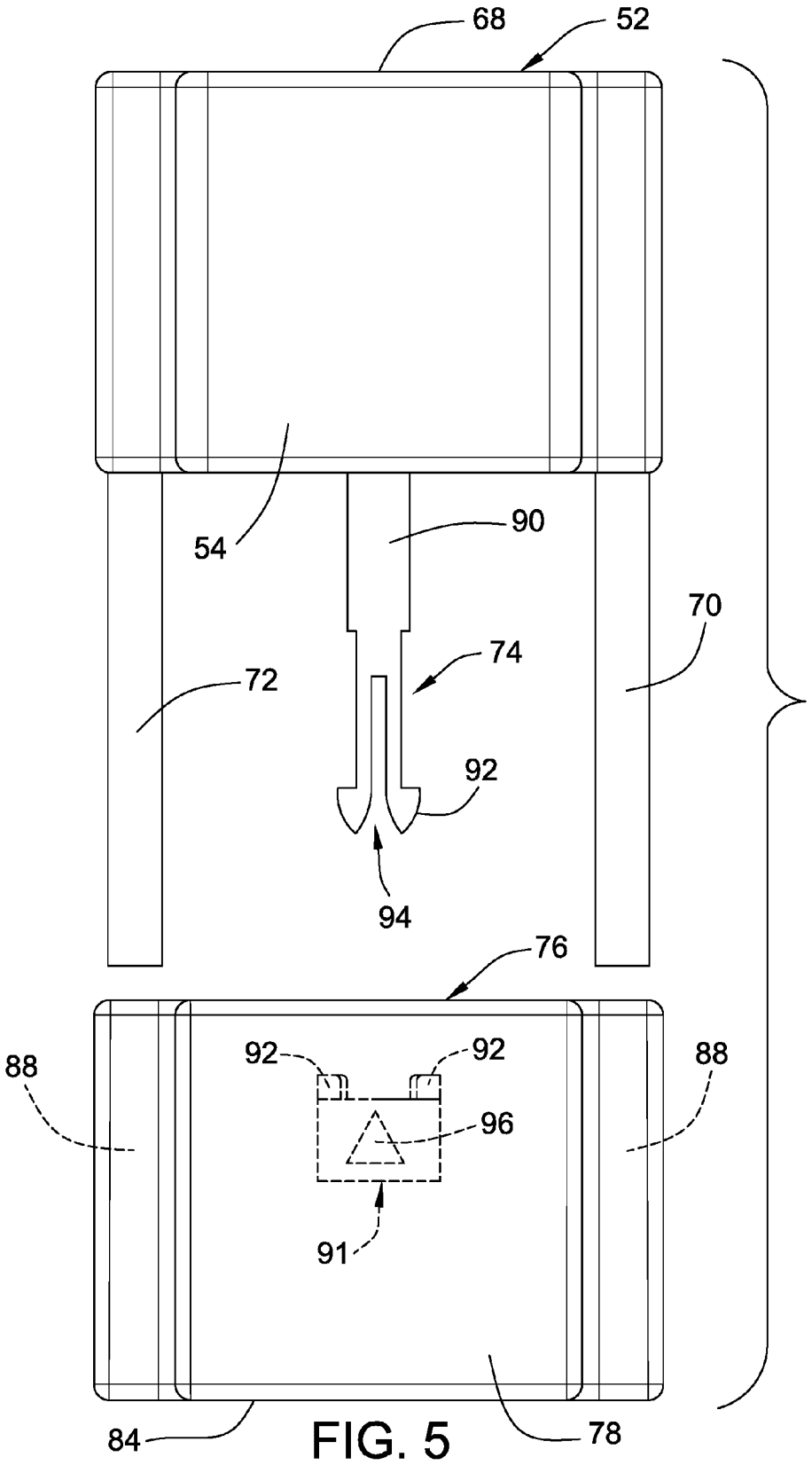
FIG. 5 is an exploded front view of the lock cover of FIG. 3.
Figures 6, 7:
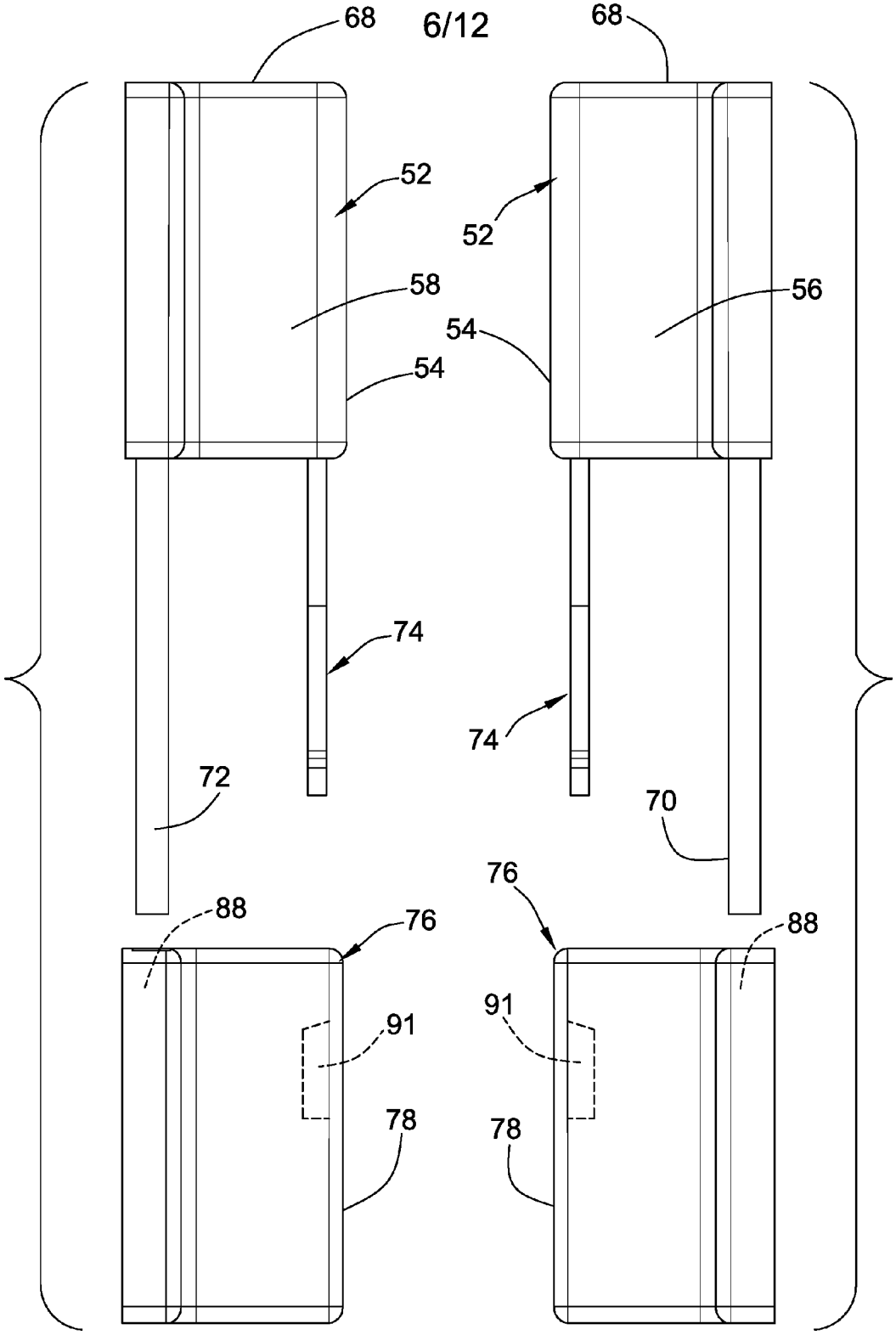
FIG. 6 is an exploded left side view of the lock cover of FIG. 3.
FIG. 7 is an exploded right view of the lock cover of FIG. 3.
Figure 8:
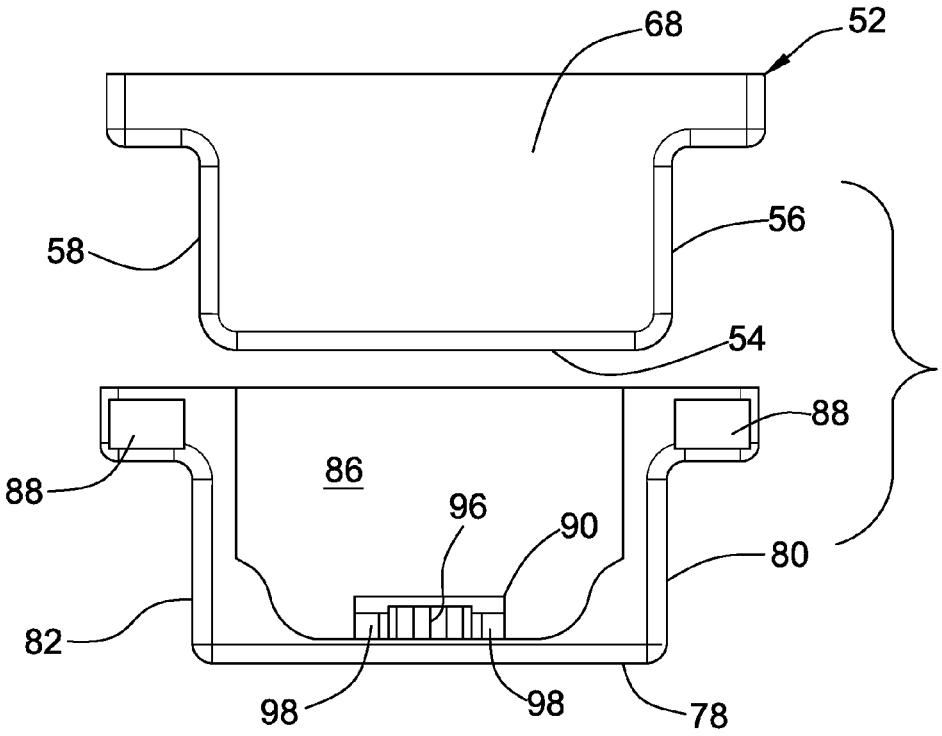
FIG. 8 is an exploded top view of the lock cover of FIG. 3.
Figure 9:
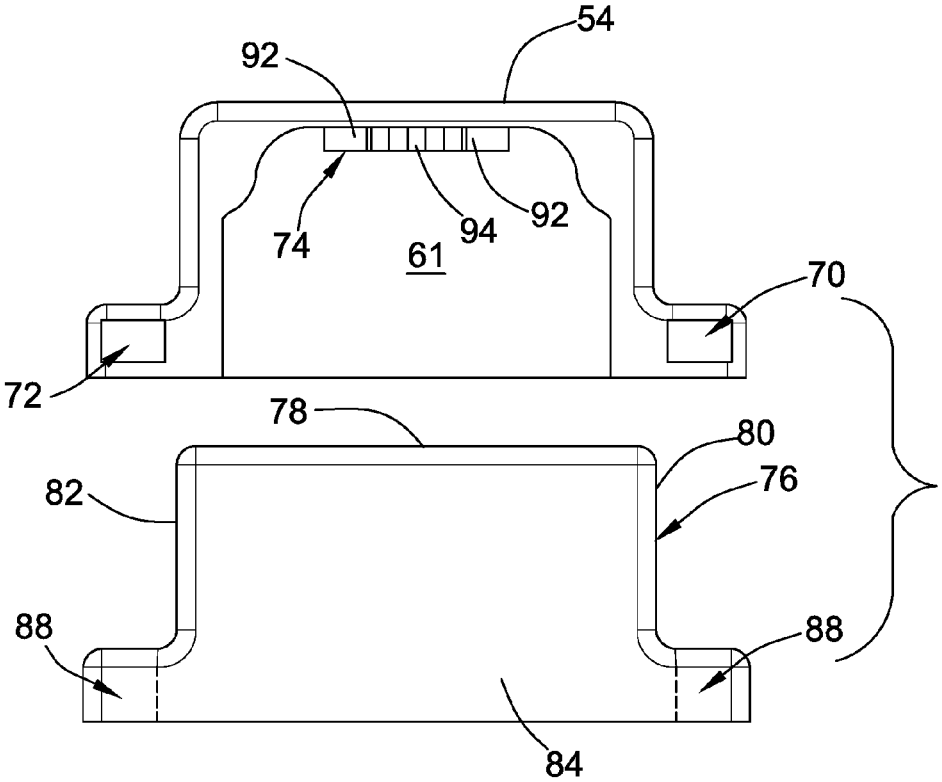
FIG. 9 is an exploded bottom view of the lock cover of FIG. 3.

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

FIGS. 3-9 show an embodiment of a lock cover 50 including a first housing 52. The first housing 52 may be formed of plastic, metal, composite materials, or any suitable material. The material of the first housing 52 may be selected with the operating environment in mind, which includes a wide range of temperatures, weather conditions, sunlight, and the need for a construction that is resistant to breakage, intentional or accidental.

The first housing 52 includes a first front wall 54 and laterally opposed first side walls 56, 58. The first side walls 56, 58 may be planar, or stepped as shown, or may be non-planar, i.e., curved. The first side wall 56, on the right side of the first housing 52, includes a front edge 60 that joins the first side wall to the first front wall 54 and a rear edge 62. The first side wall 58, on the left side of the first housing 52, includes a front edge 64 that joins the first side wall to the first front wall 54 and a rear edge 66. The first housing 52 includes a top end wall 68 attached to the first front wall 54 and first side walls 56, 58. The first front wall 54, first side walls 56, 58, and top end wall 68 define a first housing interior 61.

The illustrated embodiment shows a pair of guide legs 70, 72. The guide legs 70, 72 are disposed on the first housing 52 and extend from a position on the first housing at or near respective first side walls 65, 58 and at or near the rear edges thereof 62, 66. The guide legs 70, 72 may be rectangular, cylindrical or any suitable shape and may also be parallel to each other.

The first housing 52 may include a latch 74. The latch 74 extends from a lower edge of the front wall 54 of the first housing 52. The latch 74 may include base portion 90 attached to the front wall 54 and a terminal portion including a barb 92. The barb 92 may be formed in two parts or prongs separated by a slot or gap 94. The gap 94 permits the two parts of the barb 92 to resiliently spread apart and return.

The first housing 52 is configured to be received and retained by a second housing 76. To that end, the second housing 76 includes a second front wall 78 and laterally opposed second side walls 80, 82 that join to the second front wall in a fashion similar to that of the first housing 52. A bottom end wall 84 attaches to the second front wall 78 and the second side walls 80, 82 to close the bottom of the second housing 76. The bottom end wall 84, second front wall 78 and second side walls 80, 82 define a second housing interior 86.

A pair of guide sockets 88 are formed on the second housing 76 and are sized, shaped and oriented to slidably receive the guide legs 70, 72 when the first housing 52 is assembled to the second housing. The guide sockets 88 may be rectangular cavities formed in the second housing 76.

A catch 91 is disposed inside the second housing interior 86 on an inside of the second front wall 78 in a position to receive and retain the latch 74. The catch 91 may include compartment with a wedge 96 that fits to the gap 94 and causes the prongs of the barb 92 to be urged apart when the latch 74 is inserted into the catch 91. When the parts of the barb 92 are forced apart, the hook shape of the barb is retained by engaging with catchments 98.

Figure 10:
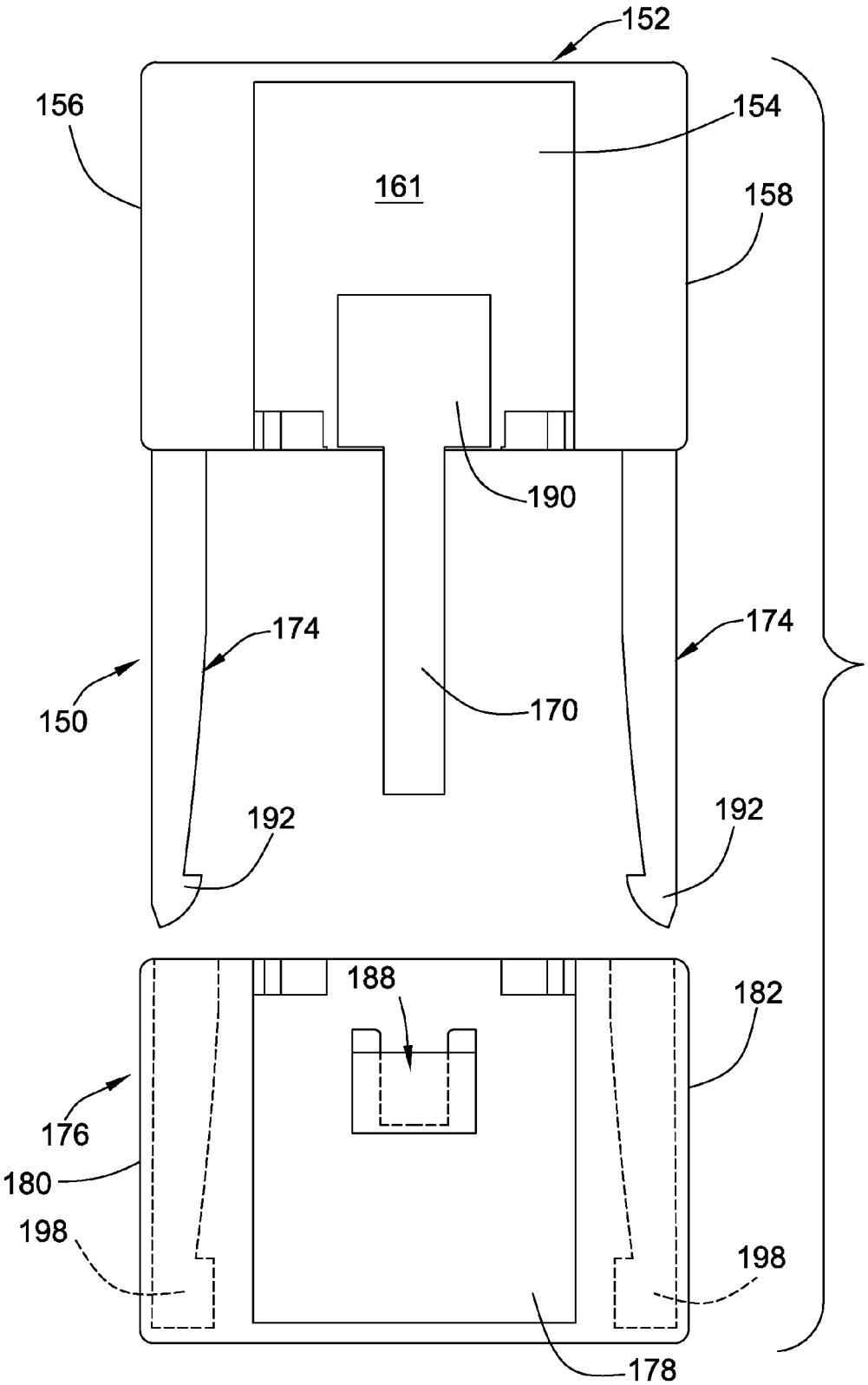
FIG. 10 is an exploded rear view of a lock cover according to another embodiment of the disclosure.

Turning to FIG. 10, an alternative embodiment of a lock cover 150 is illustrated. The lock cover 150 is similar in most aspects to the previous example. However the first housing 152, which defines a first housing interior 161, includes a single guide leg 170 extending from the inside of the first front wall 154 from a position about halfway between the pair of first sidewalls 156, 158. The latch 174 is provided as a pair of elements, one extending from a position at or near the first side wall 156 and the other extending from a position at or near the other first side wall 158. Each latch 174 includes a barb 192, which may face inwardly as shown or outwardly.

The second housing 176 includes a guide socket 188 disposed on the second front wall 178 and configured to receive the guide leg 170. Each one of a pair of catches 198 is respectively disposed at one of second side walls 180, 182 and is configured to engage and retain barb 192 of latch 174. The present embodiment therefore is the same is the embodiment of FIGS. 3-9, except the position of the guide element(s) and latch member(s) of the first housing 152 are reversed and the cooperating element(s) of the second housing 176 are also reversed.

Figure 11:
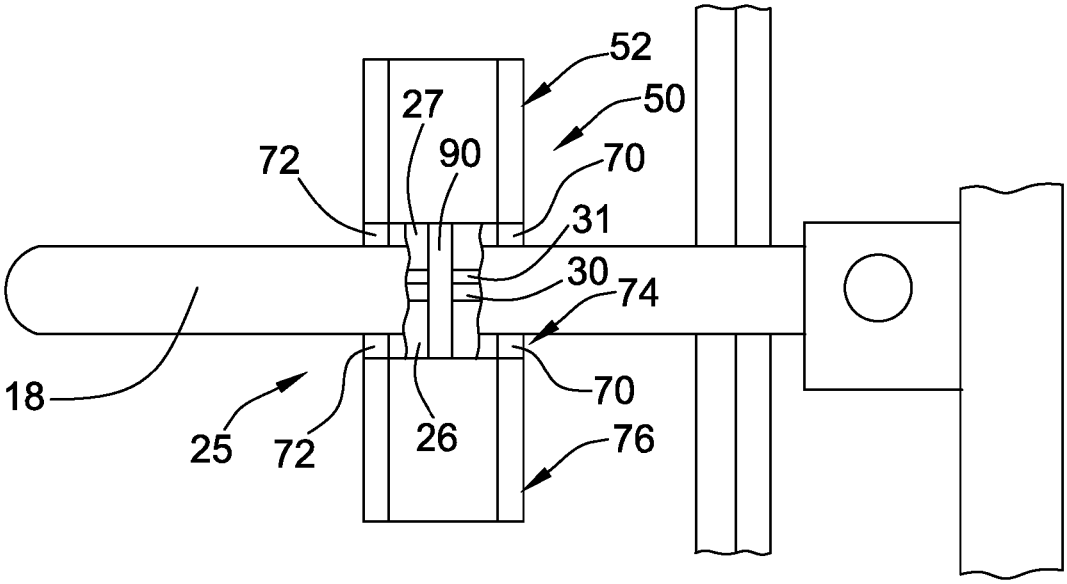
FIG. 11 is a front view of an installed lock cover according to an embodiment of the disclosure.

FIG. 11 illustrates a lock cover (for example the embodiment 50) according to any of the above embodiments installed over closure 25 and lever 18. Specifically, the guide legs 70, 72 of the first housing 52 of cover 50 is positioned behind the lever 18 and the base 80 of latch 74 is positioned in front of closure 25. The first housing 52 is brought into fastening engagement with the second housing 76 with the elements of the closure 25, such as tabs 30 and 31 extending from latching elements 26 and 27, respectively. The tabs 30 and 31 are shown in an abutting orientation whereby a lock may be employed to fasten the latching elements 26 and 27. Because the lock cover 50 is installed over the closure 25 and handle 18, the closure cannot be accessed and the lever cannot be disengaged from the closure without breaking the lock cover. Thus, the lock cover 50 prevents opening of the cargo door 11.

Figure 12:
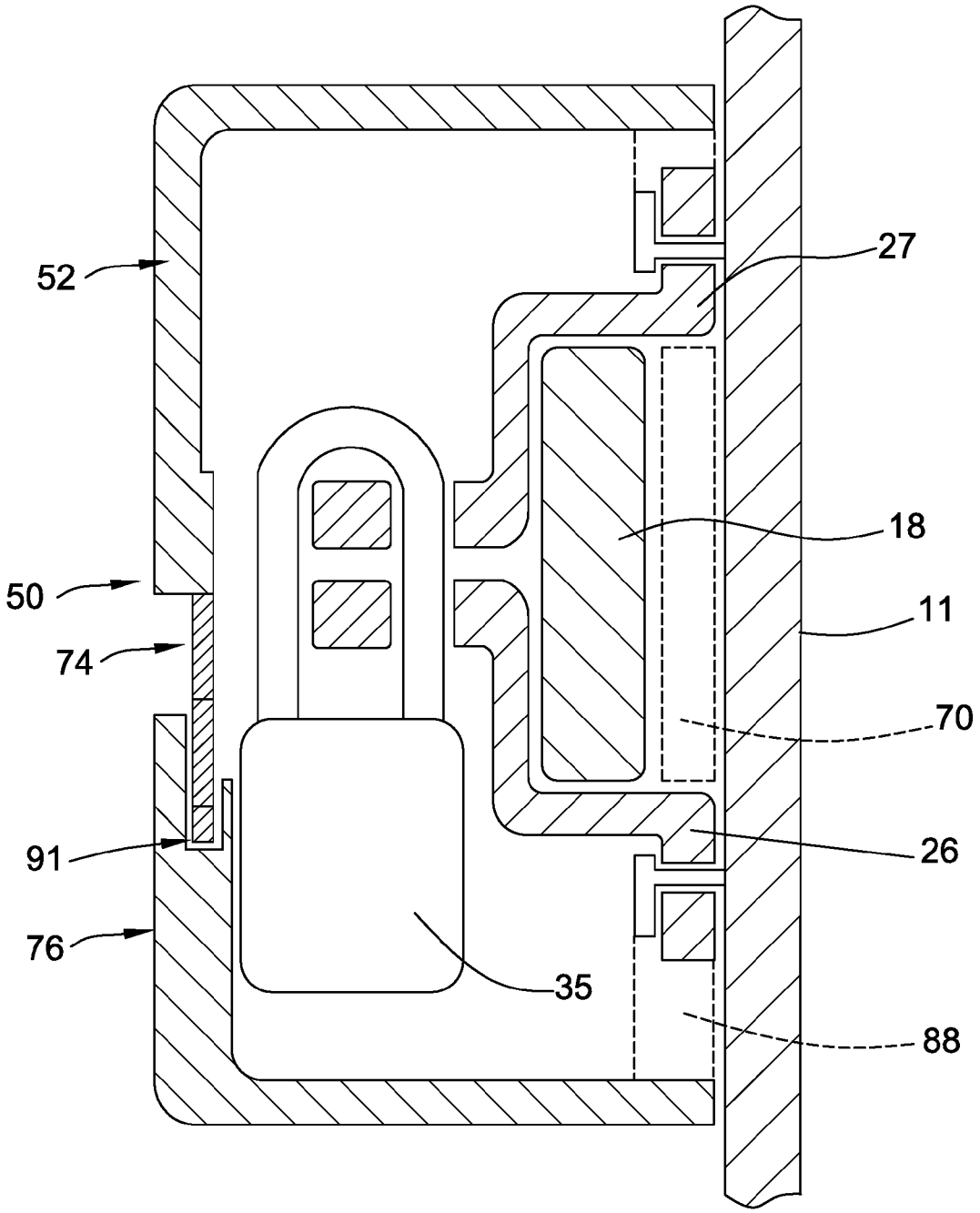
FIG. 12 is a side section view of a lock cover in position to secure a handle and closure elements of a trailer door.

Turning to FIG. 12 a door 11 of a vehicle trailer is closed by a handle 18. The handle 18 is held in a closed position by latching elements 26, 27. The latching elements 26, 27 are locked together over handle 18 with a padlock 35. Guide leg 70 of the first housing 52 of cover 50 is positioned between the door 11 and handle 18 and received in guide socket 88 of the second housing 76. While the guide leg 70 is received by the guide socket 88, the latch 74 is received by and engaged by the catch 91. First housing 52 thus generally covers the lock 35 and latch element 27 and second housing 76 generally covers the lock and the latch element 26.

Figure 13:
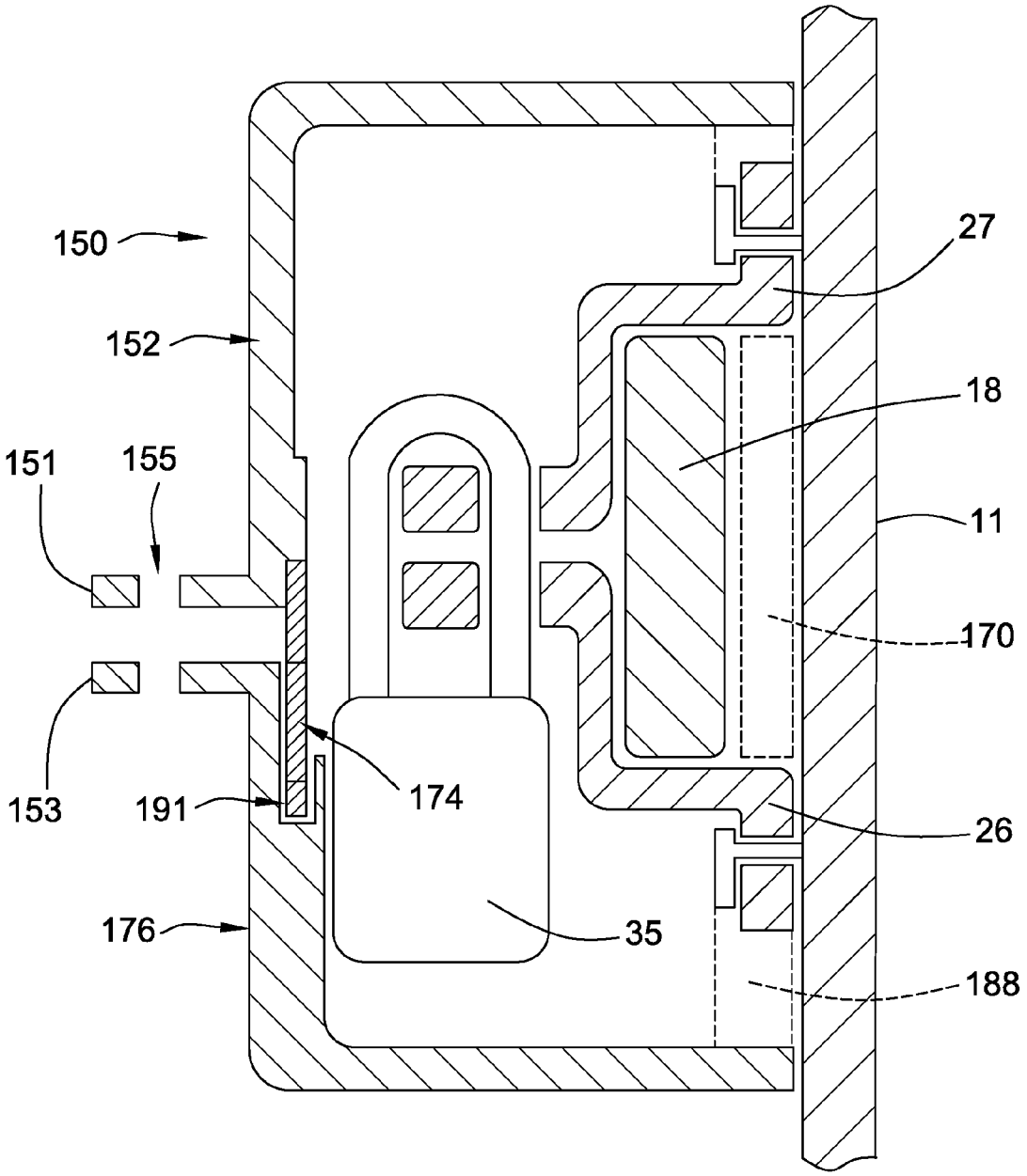
FIG. 13 is a side section view of another embodiment of a lock cover in position to secure a handle and closure elements of a trailer door.
Figure 14:
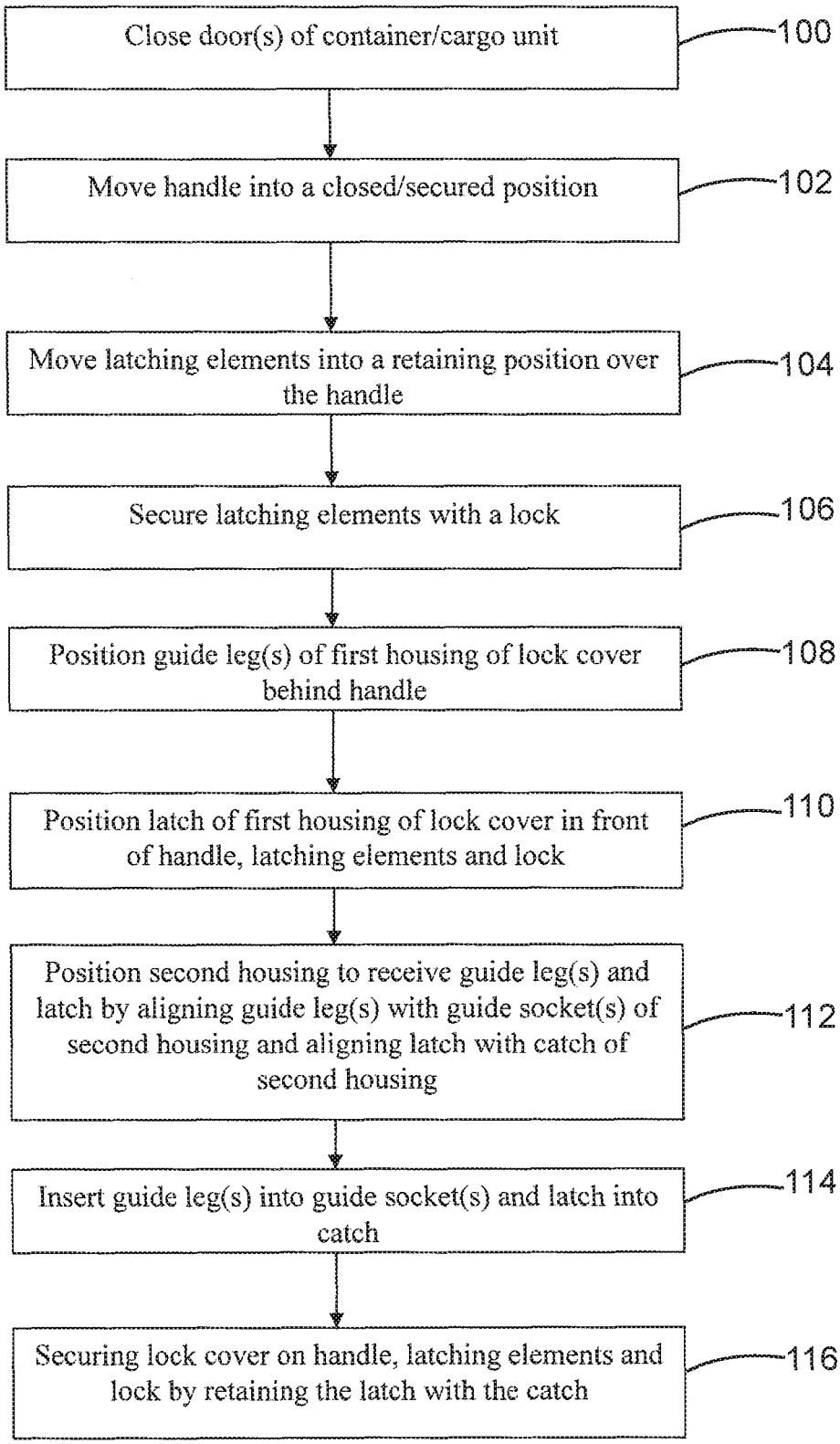
FIG. 14 is one embodiment of a method of securing a handle and closure of a trailer door with a lock cover.

Turning to FIG. 13 a door 11 of a vehicle trailer is closed by a handle 18. The handle 18 is held in a closed position by latching elements 26, 27. The latching elements 26, 27 are locked together over handle 18 with a padlock 35. Guide leg 170 of the first housing 52 of cover 150 is positioned between the door 11 and handle 18 and received in guide socket 188 of the second housing 176. While the guide leg 170 is received by the guide socket 188, the latch 174 is received by and engaged by the catch 191. First housing 152 thus generally covers the lock 35 and latch element 27 and second housing 176 generally covers the lock and the latch element 126. The first housing 152 includes an upper eyelet half 151. The second housing 176 includes a second eyelet half 153. An eyelet 155 is formed when the first and second housing parts 152, 176 are brought together as in the above embodiment (see FIG. 12). A fastener, such as a padlock, ziptie, fixable cable or other fastener is inserted through eyelet 155, which secures the cover 150 together.

Accordingly, and referring to the embodiment of FIGS. 3-9 and FIG. 14, a method of securing a handle and closure of a trailer door with a lock cover 50 is illustrated according to one embodiment of the disclosure. The container or cargo unit door 11 is closed (100) and the handle 18 is moved into a closed and/or secured position (102). Latching elements 26, 27 are moved into a retaining position over and around the handle 18 (104). The latching elements 26, 27 are secured together with a lock 35 (106). Guide legs 70, 72 of first housing 52 are positioned behind the handle 18 (108). The latch 74 of the first housing 52 is positioned in front of the handle 18, the latch elements 26, 27 and the lock 35 (110). The second housing 76 is positioned to receive the guide legs 70, 72 in guide sockets 88 by aligning the guide legs with the guide sockets. The second housing 76 is positioned to receive the latch 74 in the catch 91 of the second housing by aligning the latch with the catch (112). The guide legs 70, 72 are inserted into the guide sockets 88 and the latch 74 is inserted into the catch 91 (114). The lock cover 50 is secured in position over handle 18, the latch elements 26, 27 and the lock 35 by retaining the latch 74 with the catch 91 (116). The other embodiments are assembled in a similar fashion by aligning and attaching the guide and latch aspects of the device and retaining the two housing parts over the handle 18, the latch elements 26, 27 and the lock 35 in order to prevent access to the contents of the container.

Referring to FIG. 13, the above method may be practiced with the additional step of inserting a fastener, such as a zip-tie, cable lock, padlock, or a similar fastener, through eyelet 155 and securing the two housings 152, 176 together.

Various embodiments disclosed herein are to be taken in the illustrative and explanatory sense, and should in no way be construed as limiting of the present disclosure. While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A cover for installation on a handle of a cargo door of a cargo carrying vehicle and shipping containers to substantially cover existing top and bottom hasp elements, the cover comprising:

a first housing having a first front wall, laterally opposed first side walls attached to the first front wall, the first side walls each having a front edge and a rear edge, the first side walls attached to the first front wall at or near the front edge, and a top end wall attached to the first front and side walls, wherein the first front wall, first side walls and top end wall defines a first housing interior;

a pair of guide legs disposed on the first housing; and a latch disposed on the first housing, wherein the latch is integrally formed with the first housing; and a second housing having a second front wall, laterally opposed second side walls attached to the second front wall, the second side walls attached to the second front wall, and a bottom end wall attached to the second front and side walls, wherein the second front wall, second side walls and bottom end wall defines a second housing interior;

a pair of guide sockets formed in the second housing, the guide sockets configured as blind cavities to slidably receive the guide legs therein, wherein the legs extend through the second housing along the pair of guide sockets and terminate adjacent the bottom end wall of the second housing;

a catch integrally formed with the second housing, the catch configured to receive and permanently retain the latch and thus permanently retain the first housing to the second housing thereby;

wherein the first and second housing interiors together define a cover interior that is sized and shaped to substantially cover the top and bottom hasp elements with the guide legs disposed behind the handle and the latch disposed in front of the handle when the cover is assembled thereon; and wherein the cover is a single-use cover made from a plastic material such that the latch is breakable to release the first housing from the second housing while a portion of the latch remains engaged with the catch and a remaining portion of the latch remains integrally formed with the first housing when the first housing is permanently separated from the second housing.

2. The cover of claim 1, wherein the pair of guide legs extends from a respective one of the first side walls at or near the rear edge thereof.

3. The cover of claim 2, wherein the guide socket is a pair of guide sockets, each of the pair of guide sockets formed at or near a respective one of the second side walls.

4. The cover of claim 2, wherein the pair of guide legs are parallel to each other.

5. The cover of claim 2, wherein each of the pair of guide legs is rectangular.

6. The cover of claim 2, wherein the latch extends from the first front wall.

7. The cover of claim 6, wherein the latch is positioned between the first side walls.

8. The cover of claim 6, wherein the latch and the pair of guide legs are parallel to each other.

9. The cover of claim 8, wherein the latch includes a base portion attached to the first front wall and a barb, the barb configured to be retained by the catch member.

10. The cover of claim 9, wherein the latch includes a pair of barbs.

11. The cover of claim 10, wherein the pair of barbs are outward facing.

12. The cover of claim 11, wherein the pair of barbs are separated by a gap, the pair of barbs configured to be resiliently spread and retained by insertion into and engagement with the catch.

13. The cover of claim 11, wherein the catch includes a wedge element configured to spread the pair of barbs when the first and second housings are assembled together.

14. The cover of claim 11, wherein the catch includes a pair of catchments configured to engage and retain the pair of barbs when the wedge element spreads the pair of barbs.

15. The cover of claim 1, wherein the guide leg is disposed between the first side walls.

16. The cover of claim 15, wherein the guide leg extends from the first front wall.

17. The cover of claim 15, wherein the guide socket is disposed on the second front wall and is configured to slidably receive the guide leg.

18. The cover of claim 15, wherein the latch includes a pair of latch members extending from a respective one of the first side walls at or near the rear edge thereof.

19. The cover of claim 18, wherein each of the pair of latch members includes one or more barbs.

20. The cover of claim 19, wherein the catch includes a pair of catches, each of the pair of catches configured to retain one of the pair of latch members when engaged therewith.

21. The cover of claim 1, wherein the first front wall of the first housing includes a first eyelet half, and the second front wall of the second housing includes a second eyelet half, the first eyelet half and the second eyelet half forming an eyelet that is sized and shaped to receive a fastener to secure the first housing to the second housing thereby.

22. A method, using the lock cover of claim 1, of preventing access to the interior of a container, through a door that is closed with a handle, the handle secured with latching elements and a lock, the method comprising:

moving the handle of the container door into a secured position;

retaining the handle with the latching elements;

permanently locking the latching elements together;

positioning the guide leg of the first housing of the lock cover behind the handle;

positioning the latch of the first housing in front of the handle, the latch elements and the lock;

positioning the second housing of the lock cover to receive the guide leg by aligning the guide legs with the guide socket and to receive the latch in the catch of the second housing by aligning the latch with the catch;

inserting the guide leg into the guide socket and the latch into the catch; and securing the lock cover in position over the handle, the latch elements and the lock by permanently retaining the latch with the catch such that the latch must be broken to separate the first and second housing.

* * * * *